US012523437B2

(12) United States Patent
Käräjämies

(10) Patent No.: US 12,523,437 B2
(45) Date of Patent: Jan. 13, 2026

(54) MULTI-CALIBER FIREARM, A BOLT AND A BARREL EXTENSION

(71) Applicant: ENSIO FIREARMS OY, Sastamala (FI)

(72) Inventor: Toni Käräjämies, Sastamala (FI)

(73) Assignee: ENSIO FIREARMS OY, Sastamala (FI)

( * ) Notice: Subject to any disclaimer, the term of this patent is extended or adjusted under 35 U.S.C. 154(b) by 58 days.

(21) Appl. No.: 18/284,042

(22) PCT Filed: Mar. 24, 2022

(86) PCT No.: PCT/FI2022/050191

§ 371 (c)(1),
(2) Date: Sep. 25, 2023

(87) PCT Pub. No.: WO2022/200691

PCT Pub. Date: Sep. 29, 2022

(65) Prior Publication Data

US 2024/0175652 A1 May 30, 2024

(30) Foreign Application Priority Data

Mar. 26, 2021 (FI) ..... 20215347

(51) Int. Cl.
*F41A 11/02* (2006.01)
*F41A 3/26* (2006.01)
*F41A 9/54* (2006.01)

(52) U.S. Cl.
CPC ..... *F41A 11/02* (2013.01); *F41A 3/26* (2013.01); *F41A 9/54* (2013.01)

(58) Field of Classification Search
CPC .. F41A 11/00; F41A 11/02; F41A 3/26; F41A 9/54
See application file for complete search history.

(56) References Cited

U.S. PATENT DOCUMENTS 8,806,789 B2 * 8/2014 Devine ..... F41A 11/00 42/16
2010/0170130 A1 7/2010 Tertin
(Continued)

FOREIGN PATENT DOCUMENTS

DE 102010032592 A1 2/2012
WO WO-2011044169 A1 * 4/2011 ..... F41A 3/66

*Primary Examiner* — Jonathan C Weber
(74) *Attorney, Agent, or Firm* — Maschoff Brennan

(57) ABSTRACT

A multi-caliber firearm includes a barrel extension configured to connect to an interchangeable barrel that is selected from at least two predetermined caliber sizes. An interchangeable magazine well receives a magazine that is selected to house cartridges from the predetermined caliber sizes. The magazine well includes a first end facing towards the stock and a second end facing towards the barrel extension. A bolt carrier group includes a bolt carrier and a bolt. A reverse movement unloads a used cartridge from the bolt and a forward movement loads a new cartridge from the magazine. The bolt carrier group receives an interchangeable bolt that is selected to load and unload one of the predetermined caliber sizes. The bolt includes a longitudinal cartridge retaining notch facing towards the magazine. The cartridge retaining notch is configured to retain the new cartridge in the magazine during the reverse movement.

4 Claims, 6 Drawing Sheets

(56) References Cited

U.S. PATENT DOCUMENTS

| | | | | |
|---|---|---|---|---|
| 2010/0229445 | A1* | 9/2010 | Patel | F41A 11/02<br>42/106 |
| 2010/0307042 | A1 | 12/2010 | Jarboe et al. | |
| 2012/0297656 | A1* | 11/2012 | Langevin | F41A 3/84<br>42/16 |
| 2013/0139424 | A1* | 6/2013 | Devine | F41A 3/26<br>42/71.01 |
| 2020/0309477 | A1 | 10/2020 | Bennink | |

* cited by examiner

MULTI-CALIBER FIREARM, A BOLT AND A BARREL EXTENSION

BACKGROUND

Multi-caliber firearms are able to fire various cartridges. Often the cartridges have different calibers, wherein a barrel of the firearm may be interchangeable. Cartridges are typically housed in dedicated magazines, wherein the construction to enable various cartridges requires changing various components of the firearm. Examples of components being changed for alternative cartridge types in a semi-automatic or automatic firearm are the barrel, a lower receiver, an upper receiver, a magazine well, the magazine and the bolt carrier group.

As the number of components to be replaced increases, switching the firearm's caliber becomes more complex. A large number of interchangeable components increases the device inventory and increases the likelihood of errors when assembling an alternative caliber setup for the firearm. Having a single component from an alternative caliber setup would render the firearm useless.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

A multi-caliber firearm is disclosed hereinafter, as well as a bolt and a barrel extension for the multi-caliber firearm. The firearm may be provided to operate as an alternative caliber firearm by changing the barrel, the bolt, a magazine well and a magazine.

The bolt is connected to a bolt carrier. In a typical firearm assembly, a bolt carrier houses the bolt, leaving the bolt lugs open to be rotatably locked into the barrel extension. In one example of the multi-caliber firearm according to this disclosure, the distance between the barrel extension and the distal end of the magazine well is the same in all caliber configurations. The bolt retains the new cartridge in place and, in exemplary configurations, must fit within the travel between the barrel extension and the distal end of the magazine well. As the bolt carrier may be reused in all caliber configurations, the bolt has variable features. The bolt is exposed from the bolt carrier more than in typical firearm assemblies.

During a reverse movement, a used cartridge is removed from the barrel extension and ejected. When the bolt carrier group reaches its rearmost position, the used cartridge is ejected from the bolt, while the new cartridge rises from the magazine to a position where it may be pushed into the barrel extension. During a forward movement, a new, unused cartridge is loaded into the barrel extension by a pushing movement by the bolt. A bolt lug pushes the rear edge of the cartridge, causing the cartridge to slide into the loaded position.

To ensure correct loading action, the protruding new cartridges from the magazine must be controlled during the reverse movement. For this purpose, the bolt comprises a cartridge retaining notch facing towards the new cartridge in the magazine during the reverse movement. The cartridge retaining notch is configured to retain the new cartridge in the magazine during the reverse movement, so it will not hinder the cartridge ejection procedure. The cartridge retaining notch slides over the new cartridge, thereby keeping the new cartridge at a desired low height that will not jam the action.

The bolt length is one variable parameter in enabling the use of multiple calibers. The bolt carrier may participate in retaining the new cartridge for the initial stage of the reverse movement, but as the bolt carrier group travels backwards, the cartridge retaining notch of the bolt is used to retain the new cartridge in a lower position in the magazine. The length of the cartridge retaining notch is configured to match the length of the bolt used for the particular cartridge type. The cartridge retaining notch enables the loading and unloading for the long exposed section of the bolt used in the present multi-caliber firearm.

In one example, the bolt interacts with a barrel extension configured to receive the cartridge. When the new cartridge reaches the firing position, the bolt lugs travel through corresponding lugs of the barrel extension and the bolt rotates to lock the bolt lugs in place to withstand the firing of the cartridge. The barrel extension operates as a central component retaining the forces when the cartridge is fired. One example of the barrel extension comprises a recoil slot configured to receive a recoil block. The structure of one exemplary firearm requires that the portions susceptible to the direct effect of the recoil, such as the barrel and the bolt, are separated from the other parts, such as a stock. The stock is connected to the barrel extension by a recoil block, which is, in this example, a solid metal particle configured to withstand the recoil impact and to provide a durable means for connecting said components. The recoil slot is arranged to the barrel extension in a shape configured to interact with the recoil block. In one example, the shape of the recoil block facing towards the recoil slot is a cuboid. Other interacting shapes are possible. In this example, the barrel extension comprises threads for receiving bolts that tighten the recoil block into the recoil slot.

The multi-caliber features are enabled by replacing a small number of components; the barrel, the bolt, the magazine well and the magazine. Alternatively, in some embodiments, also the barrel extension is replaced. The component inventory may be kept low. Said multi-caliber arrangement is applicable to various firearms, automatic, semi-automatic or bolt action firearms.

Many of the attendant features will be more readily appreciated as they become better understood by reference to the following detailed description considered in connection with the accompanying drawings. The embodiments described below are not limited to implementations which solve any or all the disadvantages of known multi-caliber firearms.

BRIEF DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. However, the same or equivalent functions and sequences may be accomplished by different examples.

Although the present examples are described and illustrated herein as being implemented in an automatic or semi-automatic rifle, they are provided as an example and not a limitation. As those skilled in the art will appreciate, the present examples are suitable for application in a variety of firearms.

Figure 1:
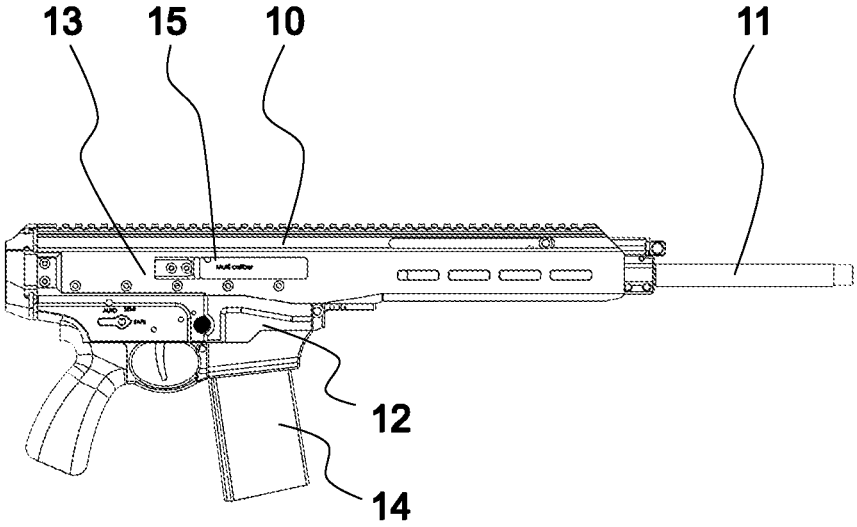
FIG. 1 illustrates schematically a left side view of one exemplary embodiment of a multi-caliber firearm.

FIG. 1 illustrates schematically one exemplary embodiment of a multi-caliber firearm 10. The firearm 10 is fully automatic or semi-automatic. The barrel 11 is interchangeable. The interchangeable barrel 11 is selected from a group of barrels supporting at least two predetermined caliber sizes. A magazine 14 is connected to a magazine well 12. The magazine 14 is selected to house cartridges from said at least two predetermined caliber sizes. The magazine well 12 interacts with the magazine 14 by receiving and locking the magazine 14 or releasing the magazine 14. The magazine 14 may be a standard magazine, for example configured to fit either AR-15, M-16 or AK-47 type firearms. The magazine well 12 is interchangeable, thereby enabling the use of standard magazines 14. The upper receiver 13 houses a bolt carrier group and the path to enable the reciprocating movement. FIG. 1 shows the context of one exemplary firearm for the devices disclosed herein. The firearm may be provided with various alternative stock configurations. As explained hereinafter, the multi-caliber functionality may depend on the selection of predetermined caliber sizes.

Figure 2:
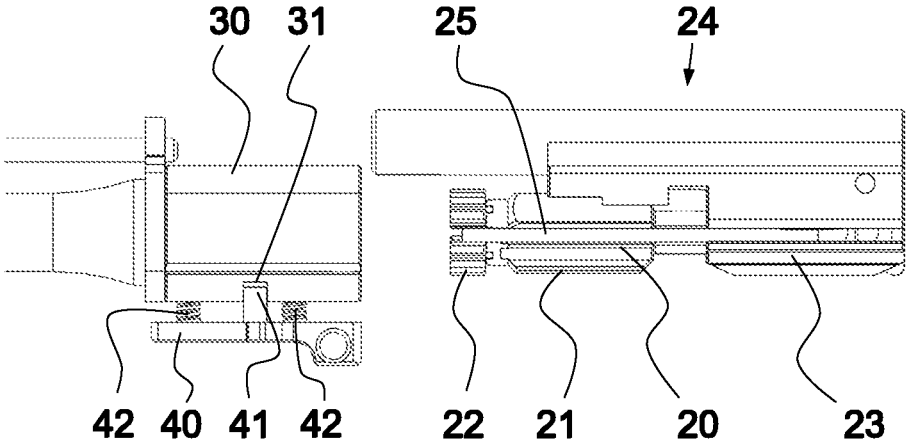
FIG. 2 illustrates schematically a right side view of exemplary embodiments of a bolt carrier group and a barrel extension.

FIG. 2 illustrates a side view of exemplary embodiments of a bolt carrier group 24 and a barrel extension 30. The bolt carrier group 24 is illustrated partially, comprising a bolt carrier 23 and a bolt 20. The bolt 20 is connected to the bolt carrier 23, being configured to rotate when the bolt lugs 22 have travelled through matching lugs of the barrel extension 30. A reverse movement of the bolt carrier group 24 is configured to unload a used cartridge from the bolt 20. A forward movement is configured to load a new cartridge from the magazine 14. The bolt carrier 23 retains its orientation during the reverse and forward movements, while the bolt 20 rotates by a cam pin sliding in the cam slot arranged to the bolt carrier 23.

The bolt 20 is interchangeably connected to the bolt carrier 23. The bolt 20 may be selected from a group of bolts being configured to load and unload one of said at least two predetermined caliber sizes. The bolt 20 is selected to match the cartridge and caliber size of the barrel 11.

The bolt 20 comprises a cartridge retaining notch 21 facing down, or when the bolt is assembled in the firearm 10, towards the magazine 14. The cartridge retaining notch 21 is configured to retain the new cartridge in the magazine 14 during the reverse movement. In a conventional bolt carrier group, the bolt would protrude from the bolt carrier by the bolt lugs and the bolt carrier would be responsible for retaining the new cartridge. In the present disclosure, the bolt carrier 23 may be reused for said at least two predetermined caliber sizes. As the distance between the bolt carrier 23 and the barrel extension 30 is the same for all predetermined caliber sizes, the bolt 20 is used to adjust to the different sized cartridges.

Figure 3:
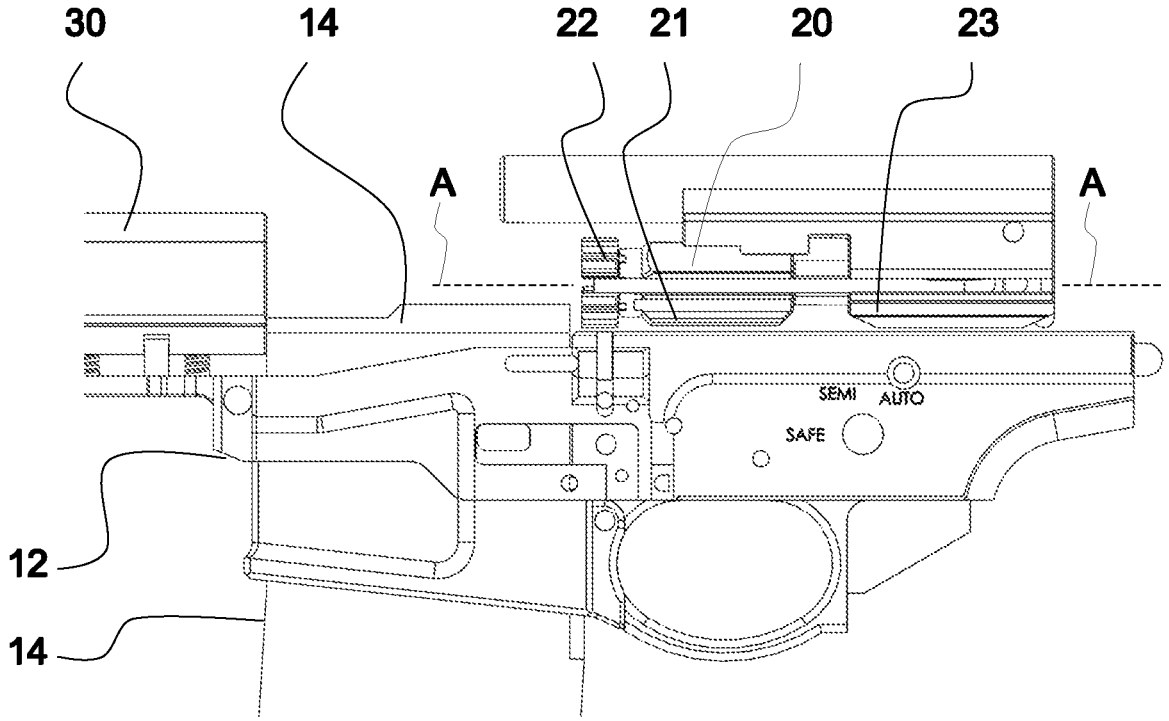
FIG. 3 illustrates a left side view of the same exemplary embodiment.
Figure 4:
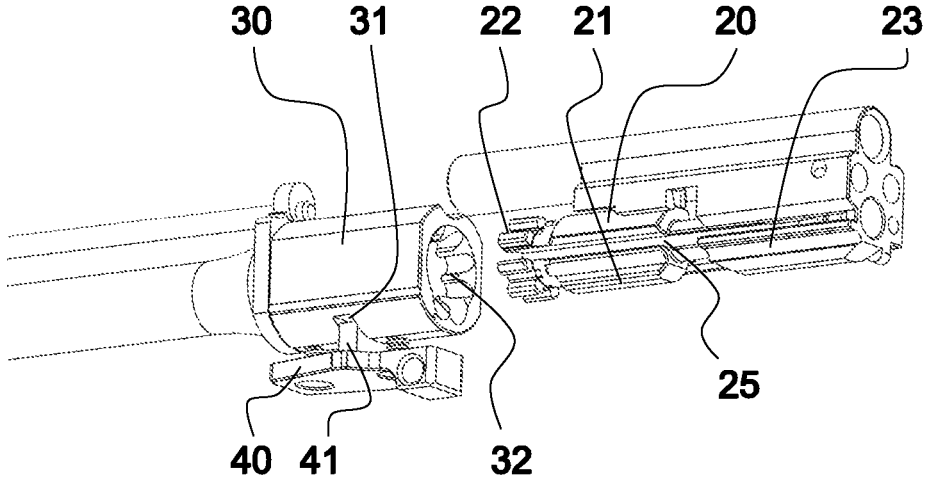
FIG. 4 illustrates an isometric view of the same exemplary embodiment.

FIG. 3 illustrates a left side view of the same exemplary embodiment illustrating the interaction with the magazine 14. FIG. 4 is an isometric view of the same embodiment. The bolt 20 is in its rearmost position, without cartridges in the magazine 14. The magazine well 12 comprises a first end facing towards the stock, i.e. backwards, and a second end facing towards the barrel extension 30.

In one embodiment, the distance between the first end of the magazine well 12 and the end of the barrel extension 30 facing towards the bolt 20 is the same for the at least two predetermined caliber sizes. The distance between the first end of the magazine well 12 and the receiving end of the barrel extension 30 defines one dimension of the space configured to operate the loading and unloading of the predetermined caliber sizes of the multi-caliber firearm 10. Alternatively, the barrel extension 30 length may be selected from a group of barrel extensions 30.

Different cartridge lengths are compensated for by corresponding bolt 20 lengths. If the cartridge retaining notch 21 were to be missing from the bolt 20, the new cartridge—that is pushed by a spring upwards from the magazine 14—could rise too high. That could cause various malfunctions, for example a bullet tip could scrape the bolt lugs 22 while travelling backwards. That might turn the cartridge into a position where it would not enter the barrel extension 30 when the bolt lugs 22 push it during the forward movement. The result might be a cartridge malfunction, failure to feed the cartridge into the firing chamber or some other mechanical malfunction.

FIG. 3 illustrates one exemplary embodiment, in which the radial distance from the axis A of the bolt carrier 23 towards the magazine well 12 has less than 1.5 mm difference between the cartridge retaining notch 21 and the bolt carrier 23 portion facing towards the magazine well 12. In this disclosure, it is assumed that the bolt 20 and the bolt carrier 23 have a common longitudinal axis. The longitudinal direction is parallel to the barrel 11. The lowest portion of the bolt carrier 23 is no more than 1.5 mm lower than the lowest portion of the cartridge retaining notch 21. The cartridge retaining notch 21 may allow some movement for the cartridge. In one embodiment, the cartridge retaining notch and the bolt carrier 23 portion facing towards the magazine well 12 have the same radial distance from the axis A. In one embodiment, the cartridge retaining notch 21 is longitudinally uniform, extending from the portion of the bolt 20 entering the barrel extension 30 opening to at least the position where the cartridge case comprises a sliding surface. The cartridge retaining notch 21 is configured to rotate with the bolt 20 when the bolt 20 enters the firing chamber and the bolt lugs 22 lock into the barrel extension 30.

Figure 5:
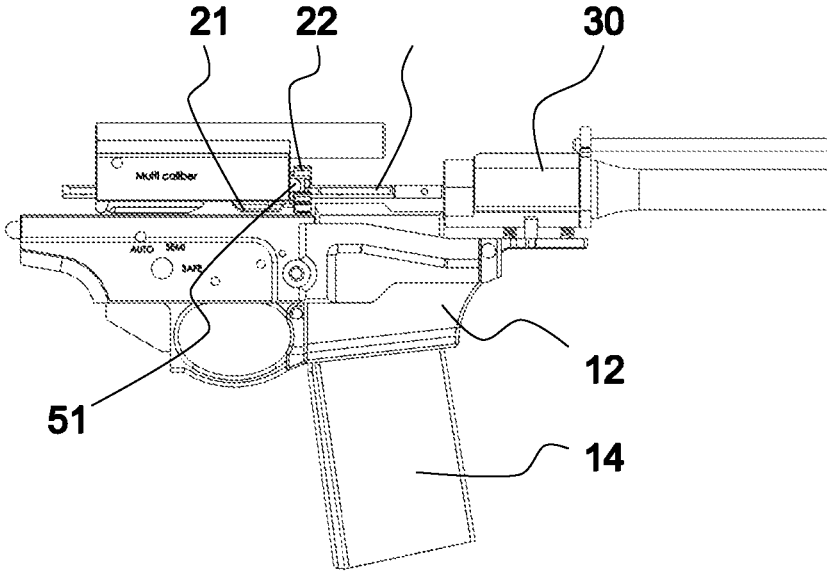
FIG. 5 illustrates schematically a right side view of exemplary embodiments.

FIG. 5 illustrates a right side view of the same embodiment, with a partial upper receiver 13. In one embodiment, the upper receiver 13 comprises a rail 50 at the left side of the bolt carrier group 24, facing towards the bolt carrier 23 and the bolt 20. The bolt carrier 23 and the bolt 20 comprise an ejector groove 25 configured to match the rail 50, wherein the bolt carrier group 24 is configured to travel along said rail 50. The rail 50 comprises an ejector notch configured to push the cartridge from an extractor 51 during the reverse movement. The extractor 51 pulls the cartridge from the firing chamber during the reverse movement. The rail 50, the ejector groove 25 and the extractor 51 together provide a simple mechanism that supports multiple cartridge types, while the bolt 20 itself may be simple. Regarding the ejector mechanism and the multi-caliber support, the bolt 20 is the only active component that must be replaced—the upper receiver 13, the bolt carrier 23 and the rail 50 may remain the same. There is no requirement for complex ejector pin mechanisms operating inside the bolt 20 that could jam under harsh conditions. The rail structure for ejecting the cartridge is known in automatic firearms, for example in the AK47.

Figure 6:
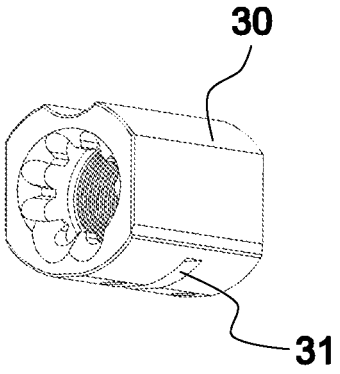
FIG. 6 illustrates an isometric view of one exemplary embodiment of one barrel extension.

FIG. 6 illustrates one exemplary embodiment of the barrel extension 30. In one embodiment, the barrel extension 30 comprises a recoil slot 31 configured to receive a recoil block 40. The barrel extension 30 receives the recoil impact from the firing chamber, along with the bolt 20 and the barrel 11. The recoil block 40 is configured to connect other components to the firearm while providing strong structure to the connection. In this example, the connecting means between the recoil block 40 and the barrel extension 30 are threaded bolts 42.

The recoil slot 31 and the recoil block 40 are configured to interact by a matching shape. In one embodiment, the recoil slot 31 is transverse to the barrel 11 direction. The matching shape may be curved or straight. In the present example, the recoil slot 31 is transverse to the barrel 11 direction. In one embodiment, the recoil slot 31 is configured to receive three sides of a cuboid recoil block 41 or a cuboid portion 41 of the recoil block 40. In one embodiment, the recoil block 41 is shaped to slide into the recoil slot 31 from the side, wherein the side profile of the connection may be a parallelogram or a trapezoid. The connection between the recoil slot 31 and the recoil block 40 may be a slideable connection that is locked in place by locking means.

The barrel extension 30 is configured to connect to an interchangeable barrel 11. The interchangeable barrel is 11 connectable to the barrel extension 30, for example by a thread that may be similar in all supported caliber sizes. Therefore, the barrel extension 30 may be fixed while the user replaces components to support an alternative cartridge size. The barrel extension 30 is configured to receive the bolt lugs 22 of the rotating bolt by interconnecting barrel extension lugs 32. When the bolt 20 has been locked into the barrel extension 30, the bolt 20, the barrel extension 30 and the barrel 11 define the firing chamber for the cartridge.

Figure 7:
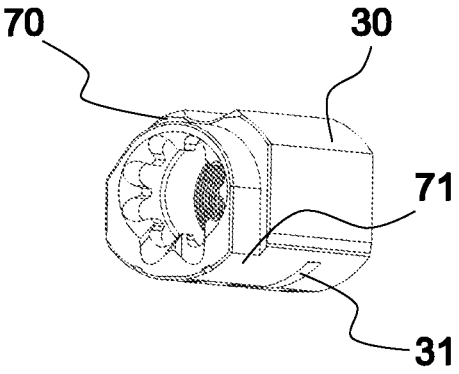
FIG. 7 illustrates an isometric view of one exemplary embodiment of one barrel extension.

FIG. 7 illustrates one exemplary embodiment of the barrel extension 30. For a portion of the predetermined caliber sizes, the barrel extension 30 is replaceable to support the selected caliber size and its cartridge. In the present example, the barrel extension 30 comprises a recess 70 and an extension 71 to the end of the barrel extension 30 facing towards the bolt 20, configured to accommodate the upper portion of the bolt carrier group 24. In one embodiment, the bolt carrier 23 is configured to operate with multiple alternative barrel extensions 30.

Figure 8A:
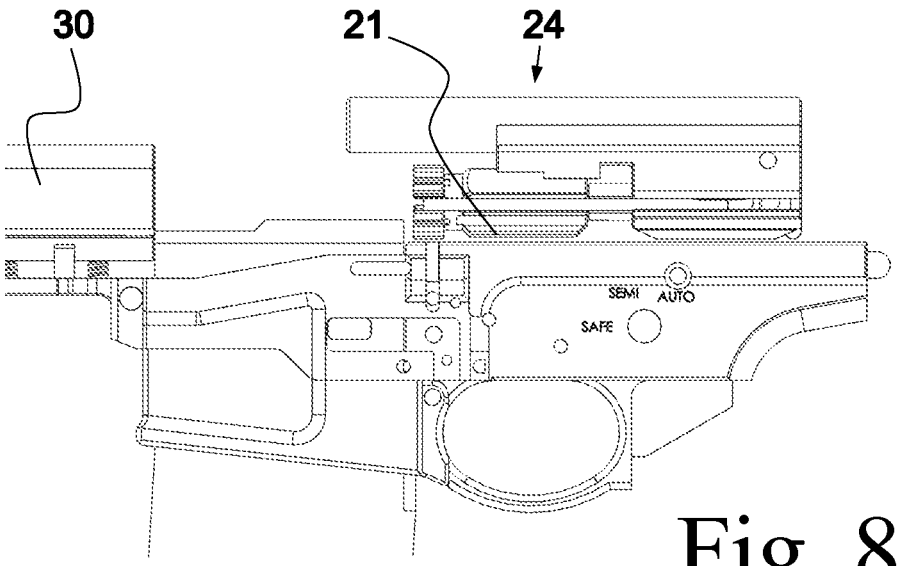
FIG. 8*a* illustrates schematically a left side view of an assembly configured to support a first cartridge size.
Figure 8B:
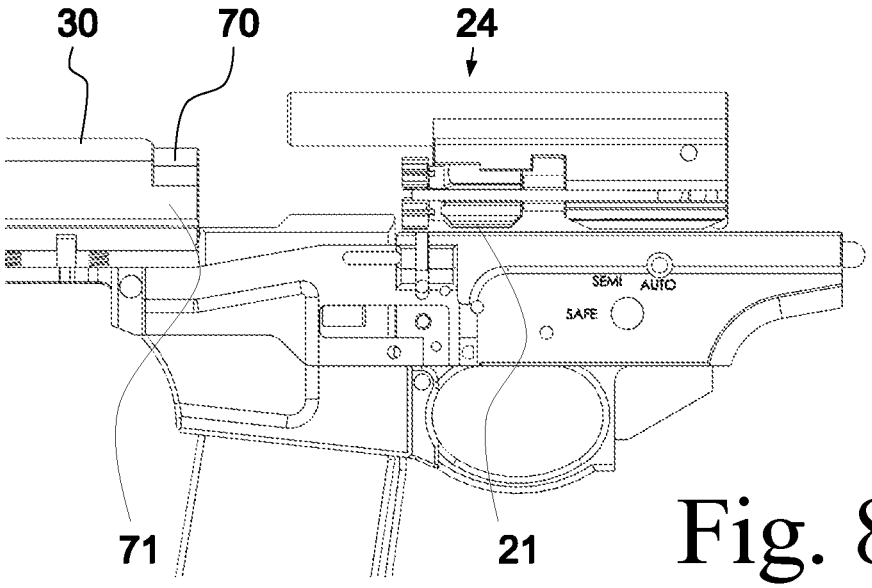
FIG. 8*b* illustrates schematically a left side view of an assembly configured to support a second cartridge size.

FIG. 8*a* and FIG. 8*b* illustrate two alternative assemblies that support two differently sized cartridges. The example of FIG. 8*a* is configured for a longer cartridge than the example of FIG. 8*b*. The reverse movement is the same for both examples. In the example of FIG. 8*b*, the bolt carrier group 24 travels over the barrel extension 30, into the recess 70. In the present examples, the different lengths of cartridges are compensated for by replacing the barrel extension 30, the bolt 20, the magazine well 12 and the magazine 14. In some embodiments, the distance between the recoil block 40 and the first end of the magazine well 12 defines one dimension of the space configured to operate the loading and unloading of the predetermined caliber sizes of the multi-caliber firearm 10. In some embodiments, replacing the barrel extension 30 alters the size and shape of the firing chamber. As one example, the barrel extension 30 illustrated in FIG. 7 may be configured to operate with longer cartridges than the barrel extension 30 of FIG. 6, as the barrel extension 30 may provide a larger portion of the firing chamber. Or alternatively, replacing the barrel extension 30 may reposition the firing chamber.

Figure 9A:
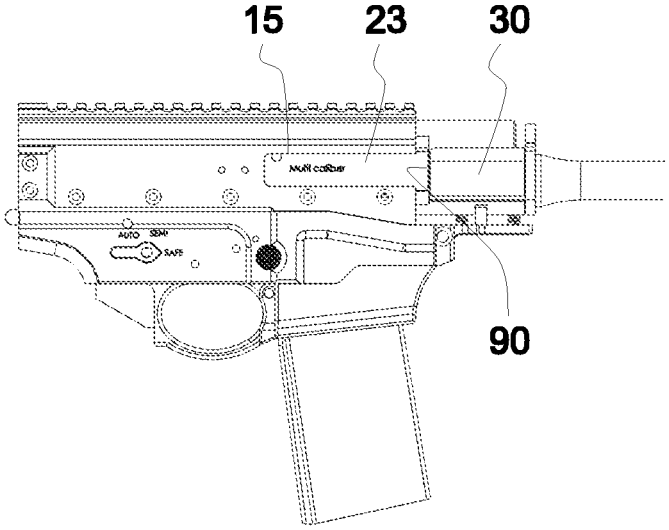
FIG. 9*a* illustrates schematically a right side view of one exemplary embodiment for covering an ejector port.
Figure 9B:
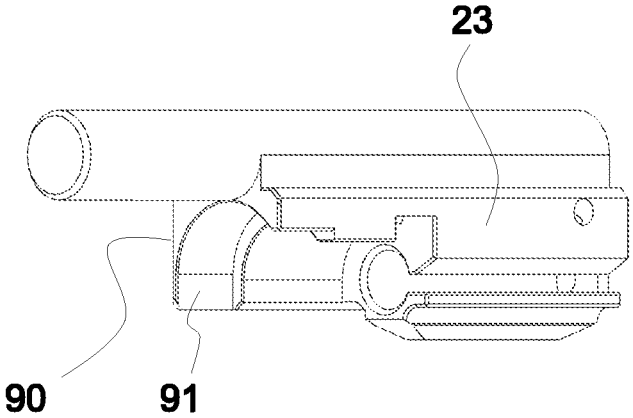
FIG. 9*b* illustrates schematically an isometric view of a bolt carrier configured to cover the ejector port.

In one embodiment, the bolt carrier group 24 is configured to cover an ejector port 15 when the bolt carrier group 24 is in the forward position and the bolt 20 is locked into the barrel extension 30. The ejector port 15 is used to eject the used cartridge from the firearm 10. In one embodiment, the bolt carrier 23 covers the ejector port 15 in the forward position and exposes the ejector port 15 in the reverse position. FIG. 9*a* illustrates schematically a right side view of one exemplary embodiment for covering the ejector port 15. FIG. 9*b* illustrates schematically an isometric view of one embodiment of the bolt carrier 23 configured to cover the ejector port 15. The bolt carrier 23 comprises an edge 90 that is configured to meet the barrel extension 30 in the locked position. The edge 90 extends backwards to a flat portion configured to cover the ejector port 15. The edge 90 travels over the ejector port 15. The arrangement covering the ejector port 15 prevents or mitigates any debris or dirt entering the ejector port 15 and/or hindering the bolt carrier group 24 movement and/or cartridge movement. In one embodiment, the bolt carrier 23 comprises a recess 91 configured to match the extension 71 of the barrel extension 30, for example the barrel extension illustrated in FIG. 7. The recess 91 may cover the barrel extension 30 only partially. Alternatively, or in addition, in the case of a short cartridge, the barrel extension 30 is placed further from the first end of the magazine well 12 and only the edge 90 covers the barrel extension 30 in the forward position.

A multi-caliber firearm is disclosed herein. The firearm comprises a barrel extension configured to connect to an interchangeable barrel, wherein the interchangeable barrel is selected from at least two predetermined caliber sizes; an interchangeable magazine well configured to receive a magazine; wherein the magazine is selected to house cartridges from said at least two predetermined caliber sizes; wherein the magazine well comprises a first end facing towards the stock and a second end facing towards the barrel extension; and a bolt carrier group comprising a bolt carrier and a bolt, wherein a reverse movement is configured to unload a used cartridge from the bolt and a forward movement is configured to load a new cartridge from the magazine. The bolt carrier group is configured to receive an interchangeable bolt, wherein the bolt is selected to load and unload one of said at least two predetermined caliber sizes;

wherein the bolt comprises a longitudinal cartridge retaining notch facing towards the magazine; and wherein the cartridge retaining notch is configured to retain the new cartridge in the magazine during the reverse movement. In one embodiment, the radial distance from the axis of the bolt carrier towards the magazine well is the same for the cartridge retaining notch and the bolt carrier portion facing towards the magazine well. In one embodiment, the radial distance from the axis of the bolt carrier towards the magazine well has less than 1.5 mm difference between the cartridge retaining notch and the bolt carrier portion facing towards the magazine well. In one embodiment, the distance between the first end of the magazine well and the end of the barrel extension facing towards the bolt is the same for the at least two predetermined caliber sizes. In one embodiment, the barrel extension comprises a recoil slot configured to receive a recoil block. In one embodiment, the recoil slot is transverse to the barrel direction. In one embodiment, the upper receiver comprises a rail and the bolt carrier group is configured to travel along said rail; and the rail comprises an ejector notch configured to push the cartridge from an extractor during the reverse movement. In one embodiment, the bolt carrier group is configured to cover an ejector port when the bolt carrier group is in the forward position and the bolt is locked into the barrel extension Alternatively, or in addition, a bolt for multi-caliber firearm is disclosed herein. The bolt is configured to rotatably interact with a bolt carrier; configured to interlock into a barrel extension, wherein said barrel extension is configured to connect to an interchangeable barrel selectable from at least two predetermined caliber sizes; and wherein said bolt is configured to unload a used cartridge by a reverse movement and to load a new cartridge by a forward movement from a magazine. The bolt is interchangeably connected to the bolt carrier, wherein the bolt is selected to load and unload one of at least two predetermined caliber sizes; wherein the bolt comprises a longitudinal cartridge retaining notch facing towards the magazine; and wherein the cartridge retaining notch is configured to retain the new cartridge in the magazine during the reverse movement. In one embodiment, the radial distance from the axis of the bolt towards the magazine well is the same for the cartridge retaining notch and the bolt carrier portion facing towards the magazine well. In one embodiment, the radial distance from the axis of the bolt towards the magazine well has less than 1.5 mm difference between the cartridge retaining notch and the bolt carrier portion facing towards the magazine well. In one embodiment, the bolt comprises an extractor and the bolt is configured to travel along a rail configured to an upper receiver, wherein said rail comprises an ejector notch, and the bolt is configured to receive the ejector notch during the reverse movement, causing the cartridge to eject from the extractor.

Alternatively, or in addition, a barrel extension for a multi-caliber firearm is disclosed. The barrel extension is configured to connect to an interchangeable barrel, wherein the interchangeable barrel is selected from at least two predetermined caliber sizes; said barrel extension being configured to receive the lugs of a rotating bolt, wherein the bolt is selected to load and unload one of said at least two predetermined caliber sizes. The barrel extension comprises a recoil slot configured to receive a recoil block. In one embodiment, the recoil slot is transverse to the barrel direction. In one embodiment, the barrel extension comprises at least one thread for tightening the recoil block into the recoil slot. In one embodiment, the recoil slot is configured to receive three sides of a cuboid recoil block.

Any range or device value given herein may be extended or altered without losing the effect sought.

Although at least a portion of the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items. Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A multi-caliber firearm, comprising:

a barrel extension configured to connect to an interchangeable barrel, wherein the interchangeable barrel is selected from at least two predetermined caliber sizes;

an interchangeable magazine well configured to receive a magazine; wherein:

the magazine is selected to house cartridges from said at least two predetermined caliber sizes; and the magazine well comprises a first end facing towards the stock and a second end facing towards the barrel extension; and a bolt carrier group comprising a bolt carrier and a bolt, wherein a reverse movement is configured to unload a used cartridge from the bolt and a forward movement is configured to load a new cartridge from the magazine; wherein the bolt carrier group is configured to receive an interchangeable bolt, wherein the bolt is selected to load and unload one of said at least two predetermined caliber sizes;

the bolt comprises a longitudinal cartridge retaining notch facing towards the magazine;

the cartridge retaining notch is configured to retain the new cartridge in the magazine during the reverse movement; and the barrel extension comprises a recoil slot configured to receive a recoil block.

2. A multi-caliber firearm according to claim 1, wherein the recoil slot is transverse to the barrel direction.

3. A multi-caliber firearm according to claim 1, wherein an upper receiver comprises a rail, the bolt carrier group is configured to travel along said rail; and the rail comprises an ejector notch configured to push the cartridge from an extractor (51) during the reverse movement.

4. A bolt for a multi-caliber firearm:

configured to rotatably interact with a bolt carrier group; and configured to interlock into a barrel extension, wherein said barrel extension is configured to connect to an interchangeable barrel selectable from at least two predetermined caliber sizes;

wherein:

said bolt is configured to unload a used cartridge by a reverse movement and to load a new cartridge by a forward movement from a magazine;

the bolt is interchangeably connected to the bolt carrier group, wherein the bolt is selected to load and unload one of at least two predetermined caliber sizes;

the bolt comprises a longitudinal cartridge retaining notch facing towards the magazine;

the cartridge retaining notch is configured to retain the new cartridge in the magazine during the reverse movement; and the bolt comprises an extractor and the bolt is configured to travel along a rail configured to an upper receiver, wherein said rail comprises an ejector notch, and the bolt is configured to receive the ejector notch during the reverse movement, causing the cartridge to eject from the extractor.

* * * * *